US007876908B2

(12) United States Patent
Hensel

(10) Patent No.: US 7,876,908 B2
(45) Date of Patent: Jan. 25, 2011

(54) PROCESS FOR THE VISUALIZATION OF HEARING ABILITY

(75) Inventor: Rolf Hensel, Zürich (CH)

(73) Assignee: Phonak AG, Stafa (CH)

( * ) Notice: Subject to any disclaimer, the term of this patent is extended or adjusted under 35 U.S.C. 154(b) by 1396 days.

(21) Appl. No.: 11/025,709

(22) Filed: Dec. 29, 2004

(65) Prior Publication Data

US 2006/0140427 A1 Jun. 29, 2006

(51) Int. Cl.
*H04R 25/00* (2006.01)

(52) U.S. Cl. ..... 381/60; 381/312; 381/314

(58) Field of Classification Search ..... 381/60, 381/312, 314, 315, 320, 321, 323; 73/585; 600/559

See application file for complete search history.

(56) References Cited

U.S. PATENT DOCUMENTS 5,835,611 A * 11/1998 Kaiser et al. ..... 381/321
7,136,492 B2 * 11/2006 Moller ..... 381/60
7,321,662 B2 * 1/2008 Lundh et al. ..... 381/314
2004/0008849 A1 1/2004 Moller

FOREIGN PATENT DOCUMENTS

DE 102 31 406 A1 1/2004
JP 09-308620 12/1997

* cited by examiner

*Primary Examiner*—Huyen D Le
(74) *Attorney, Agent, or Firm*—Pearne & Gordon LLP

(57) ABSTRACT

For the visualization of the hearing ability or hearing recognition respectively of a person with or without a hearing device at least one hearing dimension as for instance the loudness recognition is being made visible by means of a picture by varying at least one picture parameter such as for instance the brightness. The visualization can also be achieved by fade-in or fade-out of individual objects or a plurality of objects within a picture.

22 Claims, 8 Drawing Sheets

PROCESS FOR THE VISUALIZATION OF HEARING ABILITY

Figure 1:
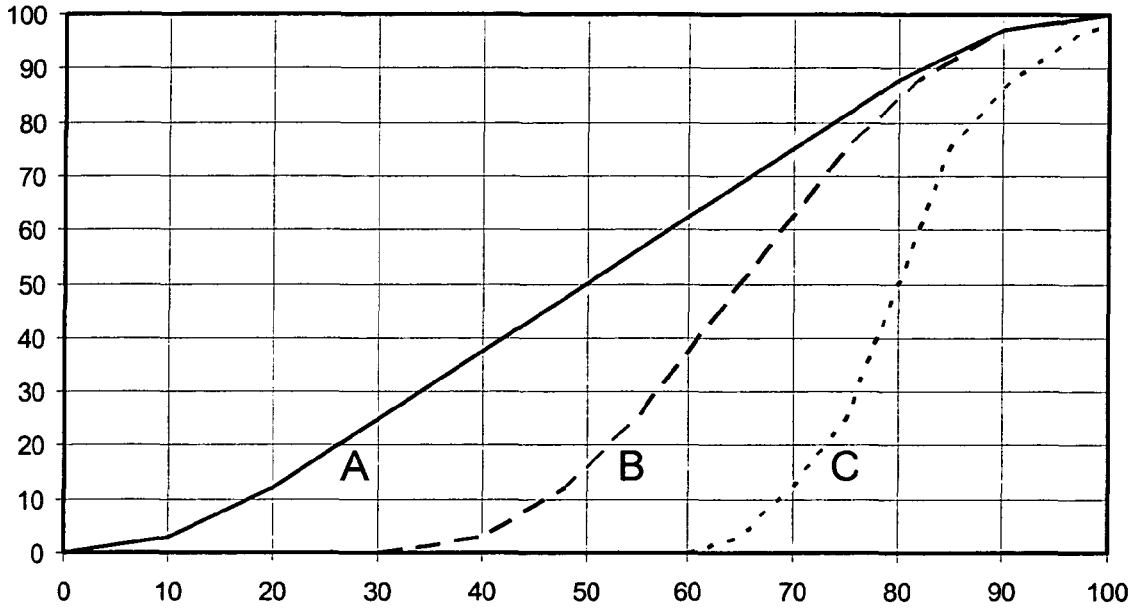

The present invention refers to a process for the visualisation according to the introduction of claim 1 as well as to a software for the execution of the process.

It is difficult to communicate hearing device settings as well as chances of the settings to a user. Out of the DE 102 31 406 a process is known to illustrate by means of an audiogram to transfer a hearing loss or hearing ability respectively via the readability of a text. The script is exact at good understanding and is getting increasingly ambiguous at increasingly worse hearing ability and furthermore some of the letters disappear partially or totally relating onto the frequency dependant hearing ability or understanding respectively.

Open still remains the presentation of the hearing device settings, which necessarily have to be chosen due to the visually illustrated text.

It is therefore an object of the present invention to propose a further possibility to visually illustrate the hearing ability with or without the aid of a hearing device.

According to the present invention the object is solved by means of a process according to the wording of claim 1 as well as by means of a software for the execution of the process.

Unlike the DE 102 31 406 the visualisation is not primarily executed my means of a text but by means of a picture. It is proposed, that by means of various picture parameters the hearing ability of a person is visually illustrated as for instance by means of brightness, contrast, image definition, colouring and/or ink coverage.

In Addition it is possible by means of a picture content to improve the visualisation as for instance by showing a discussion round in a quiet/loud surrounding. By fade-in or fade-out of individual persons and/or environment objects it can be concluded to the hearing recognition or the hearing ability respectively or the influence factors to the hearing recognition.

Primarily the visualisation is done at a certain frequency whereas it is possible or reasonable respectively to do the visual presentation at least at two, preferably three different frequency ranges as within low-sound, mid-sound or high-sound range. Again according to a further alternative of the inventive process it is possible in addition to a picture to use a text as in an analogue way described in the DE 102 31 406.

A further improvement of this present inventive process is that not only the hearing recognition of a person is made visual but also the achieved improvements by using a hearing device can be visually illustrated. By means of various picture parameters as described above furthermore a fine-tuning of the hearing device is possible which means the hearing device can exactly be adjusted according to the requirements of a person, what can be made visual by means of a picture presentation.

According to a further alternative it is proposed, that the transmission of the various determined values regarding hearing recognition or hearing ability respectively can be done by means of a software and the settings of a hearing device can be transmitted into a picture presentation.

Figure 2A:
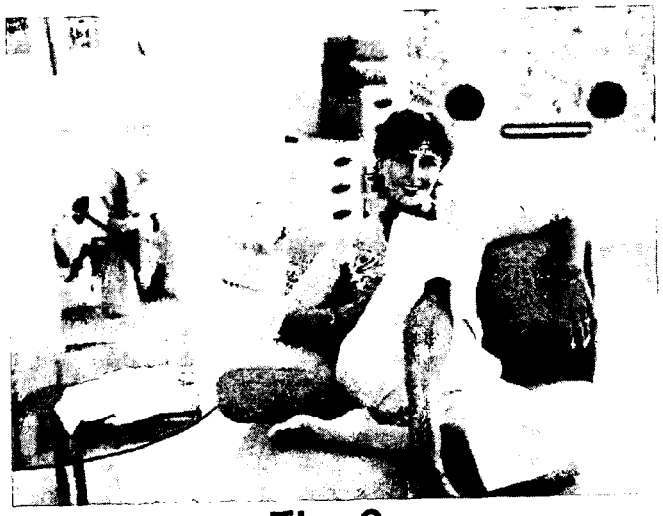
Figure 2B:
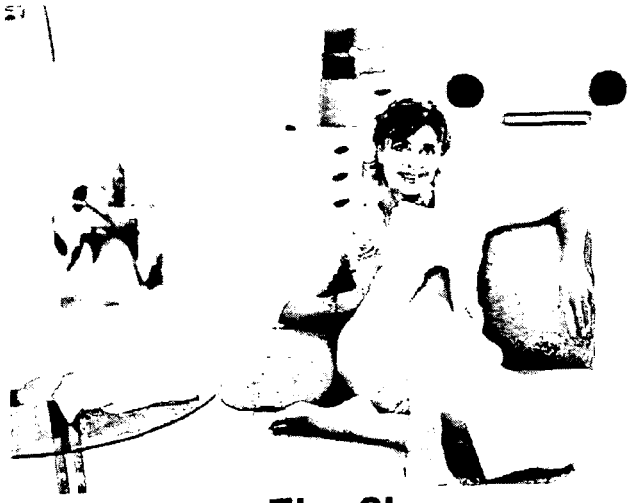
Figure 2C:
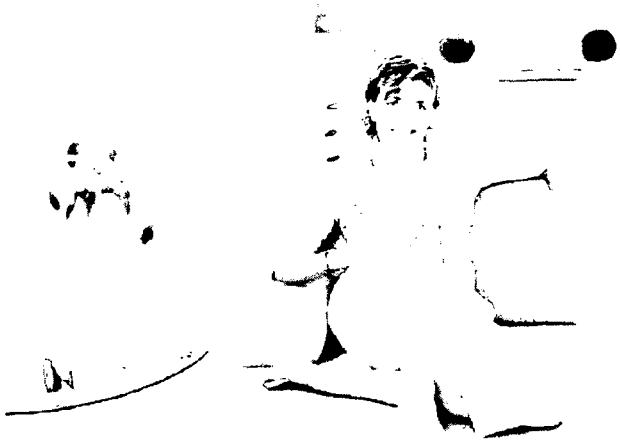
Figure 3A:
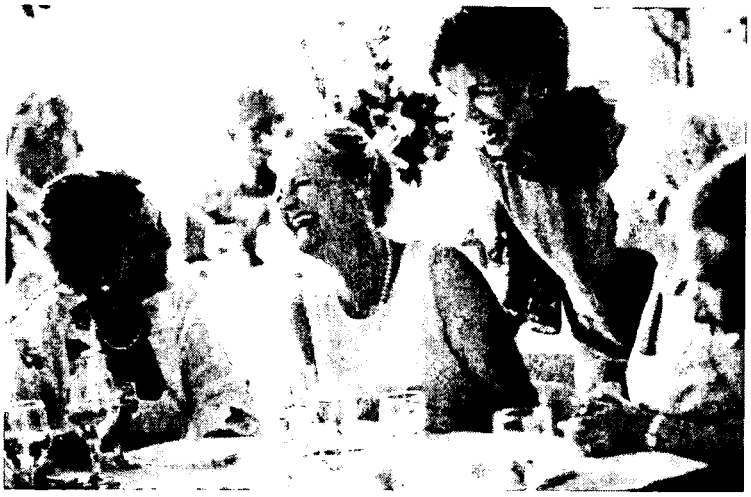
Figure 3B:
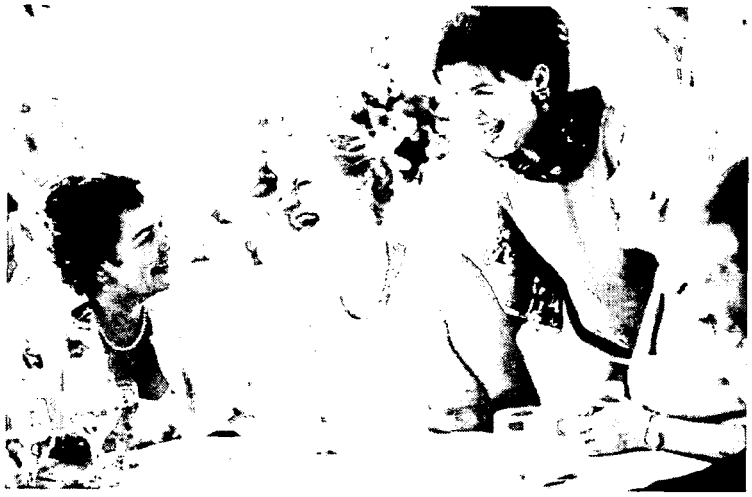
Figure 3C:
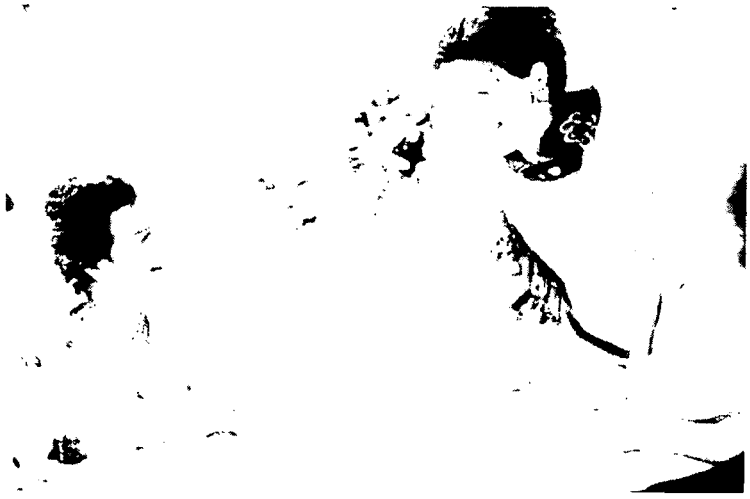
Figure 4:
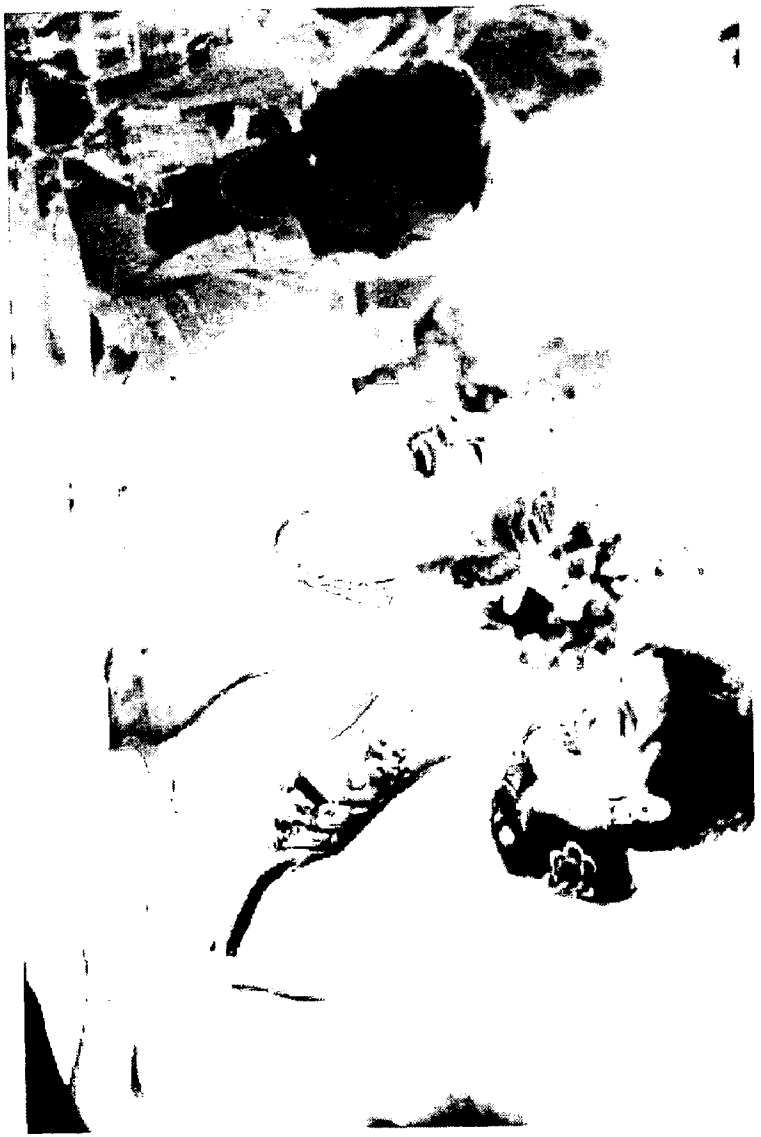
Figure 5:
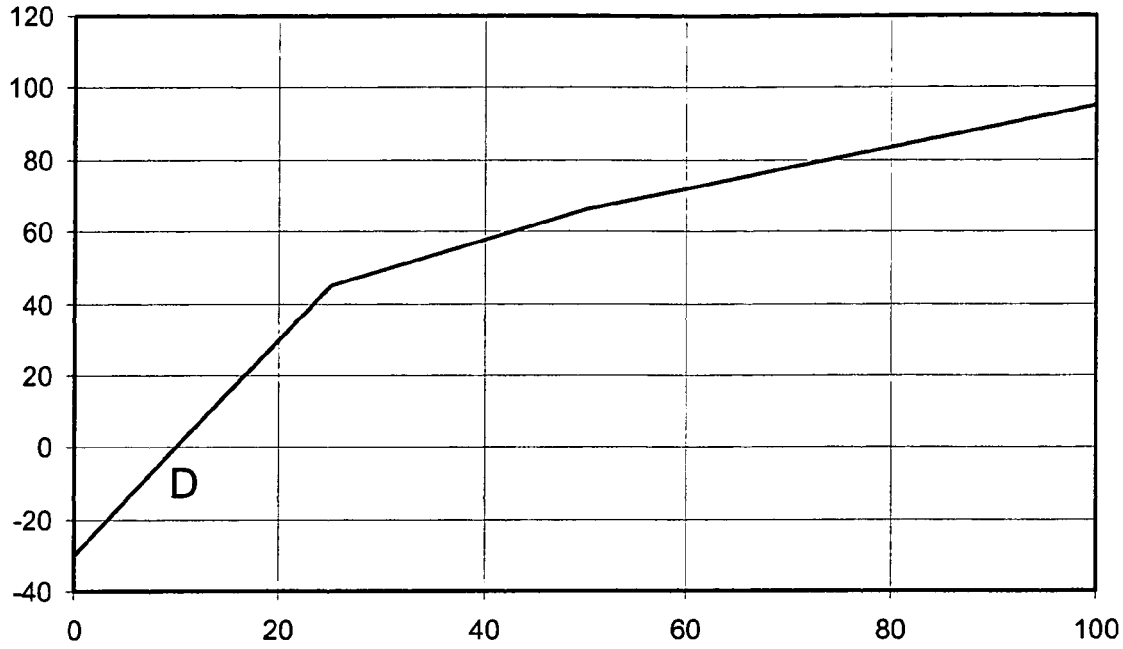
Figure 6:
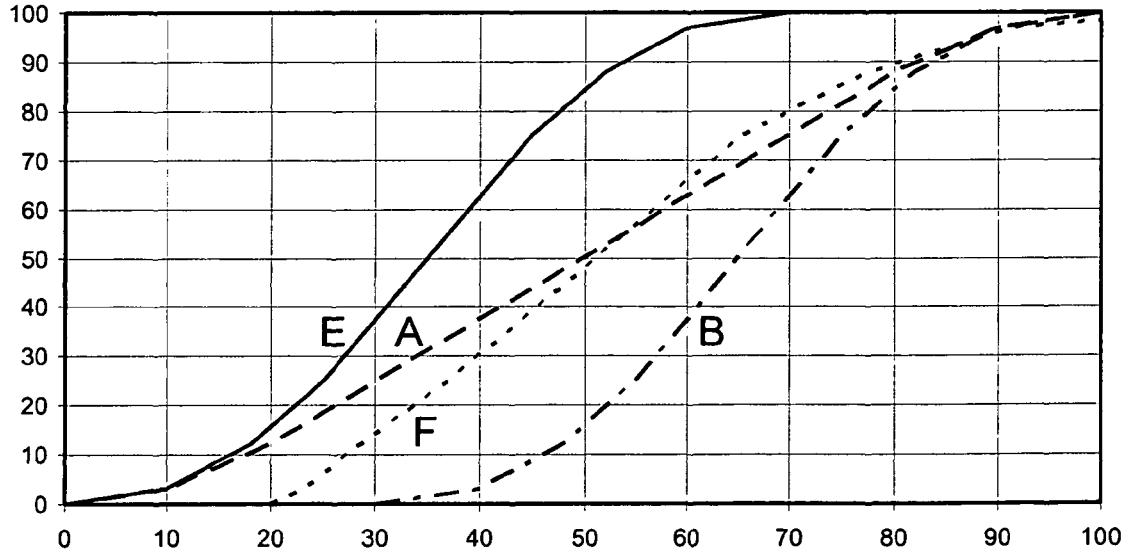
Figure 7:
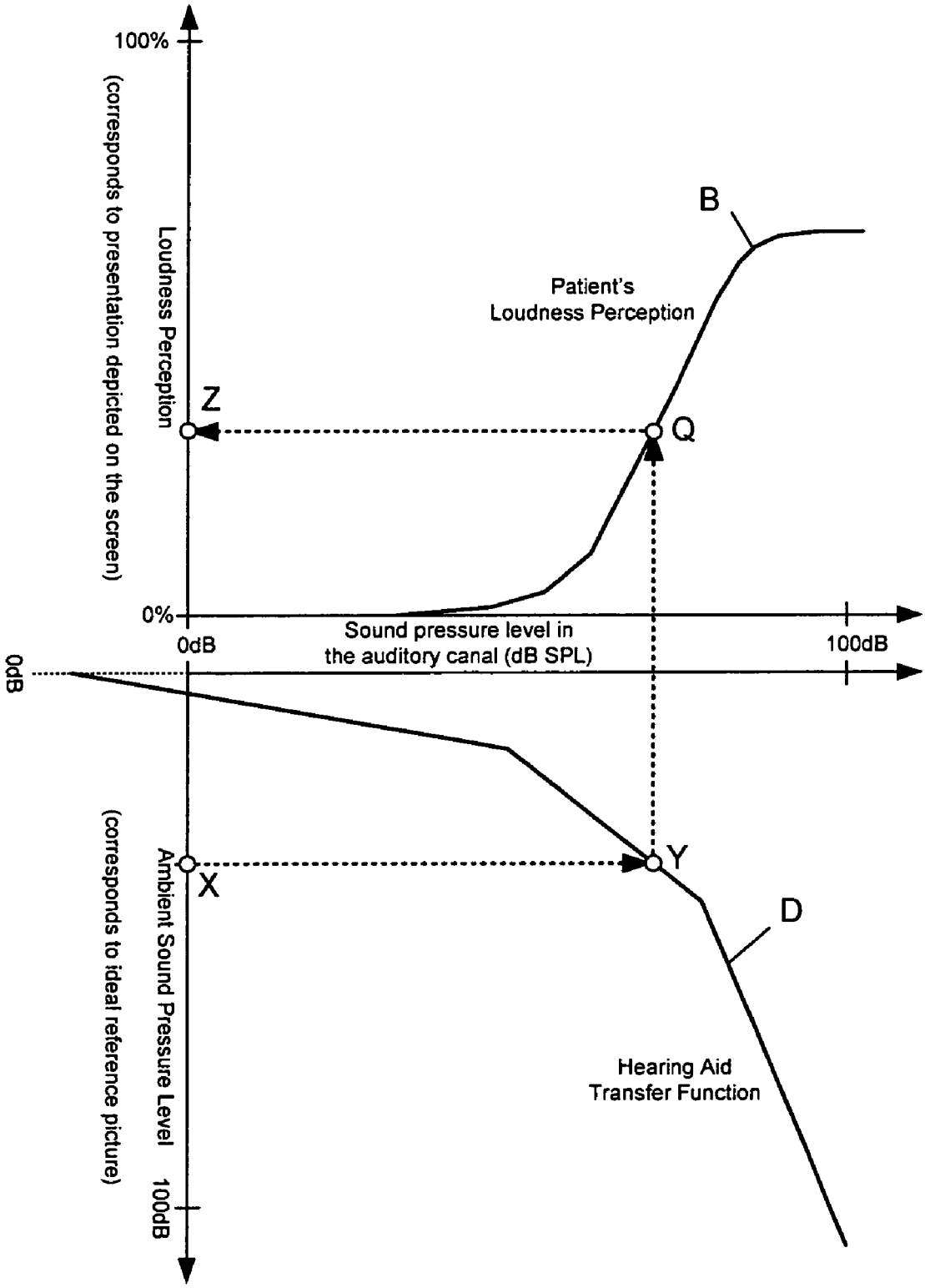
Figure 8A:
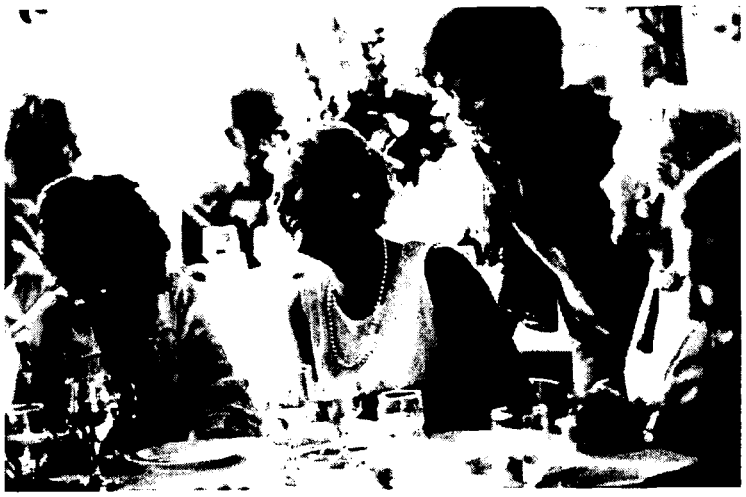
Figure 8B:
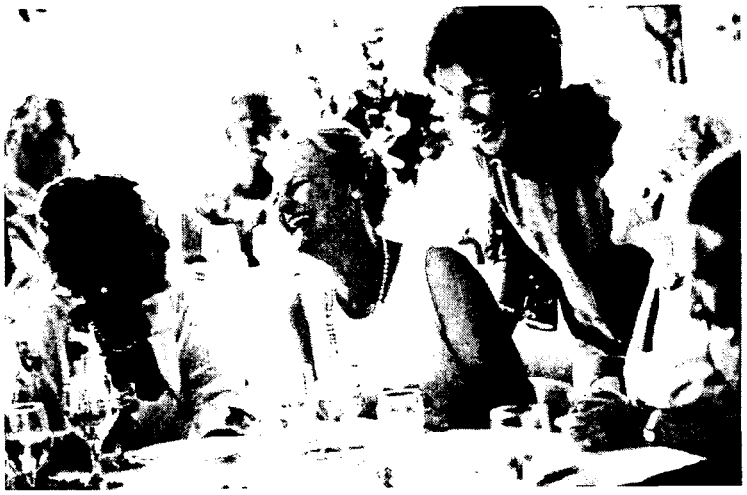
Figure 8C:
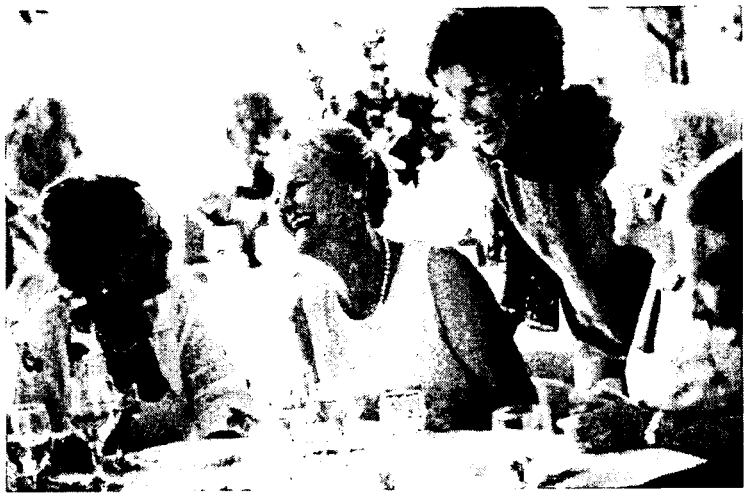
Figure 9:
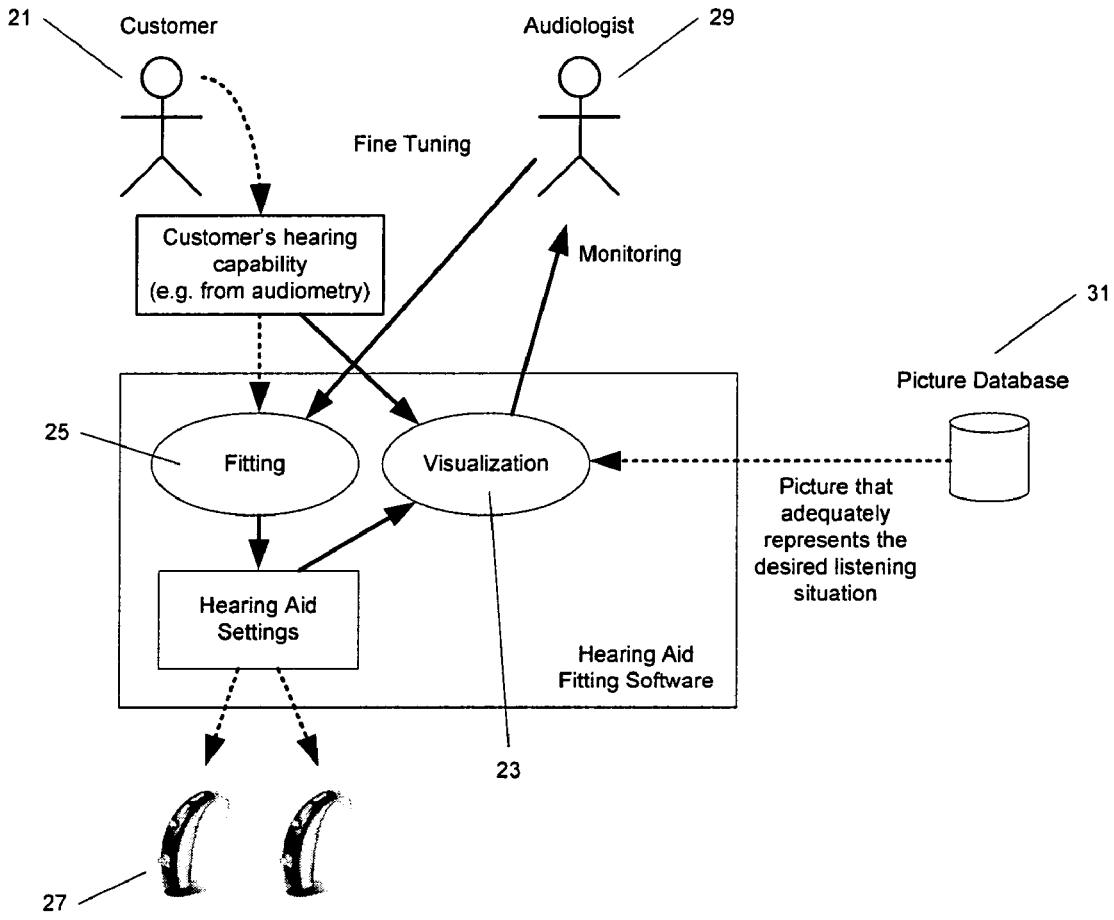

The invention is described for example and with reference to the attached drawings, in which:

FIG. 1 shows schematically as diagram the different loudness recognition from normal hearing persons and at hardness of hearing depending on the acoustic pressure, FIGS. 2*a*-2*c* show an example for the visually illustrated hearing loss in a certain frequency range, FIGS. 3*a*-3*c* show a further more complex example for the visually illustrated hearing loss within a certain frequency range, FIG. 4 shows the hearing loss of a person within three different frequency ranges shown at the same time in one picture side by side, FIG. 5 shows a hearing aid transfer-curve or the hearing device acoustic pressure respectively as function of the input acoustic pressure modified by means of an adjustment-software, FIG. 6 shows graphically the resulting hearing recognition or hearing ability respectively by using a hearing device according to the hearing aid transfer-curve as shown in FIG. 5, FIG. 7 shows graphically the transformation of raw-pictures-data by means of a transfer-curve of FIG. 5 and the resulting hearing recognition or hearing ability respectively according to FIG. 6 in a resulting picture presentation, FIGS. 8*a*-8*c* show the visual presentation of the hearing recognition or the hearing ability respectively by using a hearing device according to the hearing recognition or hearing ability respectively as shown in FIG. 6 and FIG. 9 shows schematically the adaptation of hearing device settings by using the visualisation as proposed according to the present invention.

In FIG. 1 the loudness-recognition is shown in percent depending on the acoustic pressure or the loudness respectively in decibel in a certain frequency range. Thereby curve A shows the normal characteristics, which means without any hearing loss, curve B the characteristics of a curve with a hearing loss of 30 decibel and curve C finally with a hearing loss of 60 decibel. With other words at curve B the loudness has to be at least 30 decibel before the person with the respective hearing loss can hear something.

In FIGS. 2*a*-2*c* the hearing losses of the three curves A, B and C are shown visually. Thereby FIG. 2*a* shows a picture which is practically identical with the original or which corresponds to the practically linear recognition curve A for normal hearing persons. FIG. 2*b* shows visually the hearing loss of 30 decibel. Quiet sounds which means bright colourings can not be differentiated anymore. Individual objects analogue to certain sound events as for instance the news rack 1 can not be recognised anymore.

FIG. 2*c* finally shows visually the hearing loss of 60 decibel. Only very loud sounds are recognised. Certain objects or sound events, as for instance the two round objects 3 on the windowsill, are unpleasant. It can concern to objects which are representative for noise signals.

Instead of the picture, chosen with reference to the FIGS. 2*a* to 2*c* it is also possible to use a more complex scene for the visual presentation as for instance shown in FIG. 3*a*. It can be for instance a discussion-round, which means people are shown who are discussing. In that respect FIG. 3*a* shows again the practically identical original picture according to the almost linear recognition curve A from FIG. 1. The same scene is shown in FIG. 3*b* with 30 decibel hearing loss according to curve B. At complex scenes as shown in the FIGS. 3*a* to 3*c* with many simultaneous acoustic events non important objects become more weight as for instance the hair 5 of the person right of the middle in the picture.

Picture 3*c* finally shows the same scene with 60 decibel hearing loss. The central object which means the woman 7 in the middle disappears. This is a good example for the situation of a person with severe hearing loss at hearing in an environment with strong noise.

In the FIGS. 2*a* to 2*c* as well as 3*a* to 3*c* the hearing loss of a person is shown within a certain frequency range without the use of a hearing aid or a hearing device respectively. Based upon the hearing loss as described above also the influence of a hearing device can be made visual by using pictures. Thereby the environment or input-sound or the loudness respectively is amplified by means of a hearing device.

It is reasonable to visually present the hearing loss or the loudness recognition within at least two different frequency ranges as for instance in the low-sound and the high-sound range. Of course a plurality of frequency ranges can be chosen for the presentation as for instance shown in FIG. 4 where within one single picture the visualisation of the loudness recognition within three different frequency ranges is combined. Such a combined presentation for three different frequency ranges (high-sound, mid-sound and low-sound range) can for instance also be achieved by associating each of the three colour components of a colour picture (for instance consisting of red, green and blue) to a specific frequency band. The hearing loss in the high sound range (or an adequate adjustment by means of a hearing aid in this frequency range respectively) would be recognisable in this kind of presentation by the absence for instance of red colourings.

In FIG. 5 the amplification by means of a so called compressive curve D is shown. The diagram shows the output-sound level in decibel in dependency to the input-sound level in decibel, which results due to the amplification by means of the compressive curve D. As clearly recognisable in FIG. 5 within the range of 0-20 decibel results practically no amplification of the input sound as usually within this loudness range the own noise of a hearing device is dominant. The amplification of this noise would be recognised by a user of the hearing device as unpleasant. At an input-sound level of approx. 25 decibel the compressive curve D shows a sharp bend so that above this loudness the amplification by means of the hearing device decreases compressively. If for instance the amplification is 20 decibel at an input-sound level of 40 decibel the result of the output-sound level is 60 decibel. Whereas at an input sound level of 80 decibel there is practically no need anymore of an amplification, as according to the presentation in FIG. 1 at this loudness the hearing ability is practically 100 percent.

The great advantage of such a compressive curve as shown in FIG. 5 or the compressive hearing amplification respectively results in the differentiated amplification of the input level as graphically shown in FIG. 6. Basically FIG. 6 shows analogue to FIG. 1 the recognition of loudness of the maximal loudness in dependency to the environmental sound or the input sound respectively in decibel. Again shown in dashes is curve A representative for a person without any hearing loss. Curve B is analogue to the curve in FIG. 1 corresponding to a hearing loss of 30 decibel. At a linear amplification of 30 decibel curve E would result. A person with a hearing ability correspondingly to curve E would have as a result of it already a loudness recognition of 100 percent at an environmental sound pressure of 70 decibel. With other words a louder environmental sound pressure would be recognised as unpleasant or as disturbing.

Correspondingly one reverts to the amplification according to the transmission curve D from FIG. 5, so that no amplification occurs in the range of 0 to 20 decibel. Afterwards the amplification will decrease compressively so that as louder the environmental or input-sound level pressure the smaller is the amplification. In the range of 80 to 100 decibel input-sound pressure the amplification is practically equal to 0. The resulting hearing ability or recognition curve is curve F.

To visually present in an analogue way to the pictures 2*a* to 2*c*, 3*a* to 3*c* as well as FIG. 4 the amplification by means of a hearing device the raw-picture data have to be transformed correspondingly for an effective presentation of the recognised hearing ability. Such a picture-transfer or transformation respectively is shown graphically in FIG. 7. Of course a respective determination of picture-data can be done by use of adequate software which is the basis for the graphic presentation according to FIG. 7.

It will be started from the original picture content X corresponding to the input sound pressure in decibel. Due to the compression curve D analogue FIG. 5 the respective amplification happens in intercept point Y which is transferred to the hearing ability Q in curve B corresponding to the presentation in FIG. 1. It concerns to the hearing canal sound pressure which results out of the environmental sound pressure and the amplification. From the intercept point Q on curve B finally the transmission is effected onto the individual hearing ability of the person using the hearing device resulting in point Z. This corresponds now to the visual presentation or the visualisation of the hearing ability by using a hearing aid. Correspondingly in the FIGS. 8*a* to 8*c* different hearing recognitions are shown within a certain frequency range by using a hearing device. In the following examples white corresponds to a sound pressure of 0 decibel or 0 percent loudness respectively and black to a sound pressure of 100 decibel or 100 percent loudness.

FIG. 8*a* shows the sensation of a person with 30 decibel hearing loss by using a linear hearing device which means with an amplification of 30 decibel as shown by means of curve E in FIG. 6. The linear amplification does in fact raise quiet sounds which means bright contents but as a consequence loud sounds shall become too loud. This means dark parts can not be differentiated anymore but appear only as black areas.

FIG. 8*b* again shows the visual sensation of a person with 30 decibel hearing loss, but corrected by means of a compressive hearing device according to the transfer curve D in FIG. 5 and the respective resulting hearing sensation or hearing ability respectively according to curve F out of FIG. 6. The whole picture-dynamic is somewhat compressed unlike to the following original in FIG. 8*c*. Due to the noise suppressing in the range of 0 to 20 decibel very quiet noises are not transmitted. This is visual at very bright objects such as for instance drinking glasses 9 and plates on the table. But these objects are not important; important are the persons which are discussing. These persons are shown practically equivalent as within the original corresponding to FIG. 8*c*.

By using the graphic presentation according to FIG. 7 it is of course also possible to carry out a fine tuning as for instance the characteristics of curve D is modified. By means of appropriate software curve D can practically be changed at each point without any gap so that correspondingly also the transmission by means of curve D is changed and as a consequence the position of value Q is changed.

Accordingly also completely different presentations will result for persons for which a different progression of the sensation curve according to FIG. 1 is valid. For a person whit a hearing loss of 60 decibel in particular the amplification by means of a hearing device has to be essentially stronger in the range of 20 to 60 decibel as it is the case by using curve D. But again the amplification decreases compressively which means in the range above 80 decibel the amplification is tending towards 0.

Different hearing ability as well as different amplification by means of a hearing aid influences the visualisation according to those shown in FIG. 8*a* to 8*c*. At a linear hearing amplification analogue to FIG. 8*a* the contrasts at a hearing loss of 60 decibel are essentially stronger which means bright picture contents will be increased but instead already slightly dark picture parts can practically not be differentiated anymore. This means mid-dark until dark picture parts are only recognisable as black spots.

It has to be aspired, that by means of variation of the compressive curve D by using the process according to FIG. 7 a picture can be produced, which corresponds approximately to the one in FIG. 8*b*. By using the visual presentation it is usually easier to derive an optimal hearing amplification which on one side improves the hearing ability of persons hard of hearing and on the other side also ensures a good comfort as very loud sounds are hardly or even not anymore amplified.

Again as described with reference to FIG. 4 the visualisation of loudness sensation can be done in various frequency ranges as for instance in low-sound as well as in high-sound frequency range. Instead of only a black/white presentation also the presentation in colours can be done, where preferably for various frequency ranges to be shown different colours can be chosen. For instance the visual presentation within the low-sound range is done preferably in blue while for instance for the high sound range the colour red is chosen.

The advantage of the visual presentation in colours is that now the various visualisations can be combined and from the resulting colouring the loudness sensation in the various frequency ranges within one and the same picture can be concluded. If for instance a picture does have a blue cast it can be assumed, that the loudness sensation within the low-sound range depending to the definition of the colouring may be interpreted as reduced or as increased. The same of course is the case at the picture with a green cast as for instance within the mid-sound range a reduced or increased loudness sensation can be concluded again dependent upon the interpretation of the colouring.

At all visualisations, in particular at a screen it is understood that prior to the interpretation of an visual presentation either the screen has to be calibrated or a reference picture has to be present which can be used to be compared with the effective visualisation. At the today usually used big screens it is even possible to display all the time the reference picture in a part area of the screen so that at any time it is possible to compare the visual presentation of the loudness sensation with the reference picture.

In FIG. 9 finally the process of a hearing device adjustment is shown as it is possible by means of the inventively described process. From a client 21 first of all, for instance by means of a hearing test the hearing ability or the loudness recognition is determined for instance in form of an audiogram and is visually illustrated for instance by means of a screen 23. Based upon this visualisation an acoustician 29 which is responsible for the fine-tuning is carrying out the adjustment by means of respective software 25 and after the hearing device settings are adjusted at the two hearing devices 27. For the visualisation a suitable picture will be retrieved from a picture database 31 of which according to the situation to be judged the respective picture shall be chosen. In that respect it shall be referred to the visual illustrations in the FIGS. 2 and 3.

Regarding visualisation again it has to be pointed out, that first for the visual illustration the used screen has to be calibrated or that at any time it can be reverted to the original picture out of the database 31.

After the hearing settings have been finished again from the client 21, now wearing the hearing devices the loudness recognition or the hearing ability is measured and again for instance at a screen 23 is visually illustrated. Again a control shall be done by the acoustician 29 which now is carrying out the fine-tuning. Dependant on the hearing device being adjusted more or less optimal or if a further fine-tuning is necessary the whole process shall be repeated.

As generally known the loudness recognition or the hearing ability respectively is different in different frequency ranges the whole process has to be repeated in the respective frequency ranges. Thereby the whole process should be executed at least within two frequency ranges preferably within three as for instance within the low-sound range, the mid-sound range as well as the high-sound range. This makes sense or is possible, as hearing devices usually can be derived frequency sensitive which means that the hearing amplification can be done with different intensity in different frequency ranges. Complex hearing devices can split the input sound signal into 20 frequency bands and each of these signal components can be processed differently. Such devices principally have the advantage that they can be adjusted very precisely to the individual hearing problems but as a consequence the necessary hearing device adjustment is extremely difficult and long-winded if no aids such as the inventively proposed process for the visualisation of the hearing ability or the hearing sensation are available.

The diagrams and the pictures as shown within the FIGS. 1 to 9 are of course only examples, which can be changed or modified in any manner and which can be completed by further elements. It is therefore possible and as already mentioned instead of black and white pictures also to choose colour pictures and to display the different amplifications or the hearing ability respectively by changing the colourings. By using colours it is even possible to visually display further parameters regarding hearing recognition or hearing ability respectively as for instance the influence of surrounding noises, differentiated loudness sensation, understand-ability, etc.

Furthermore by using of colourings or the ink coverage for instance also the visual display of the loudness recognition in different frequency ranges is possible as already mentioned above what even is possible in one single picture.

Also it is possible to additionally use a text which analogue to the principles as described within the DE 102 31406 can be changed or adjusted to the hearing ability or the hearing recognition respectively.

The invention claimed is:

1. Process for adjusting hearing device settings device comprising the steps:

1) determining a hearing capability of a person;

2) visualizing the hearing capability of the person by means of a picture of a scene retrieved from a picture database; and 3) adjusting the hearing device settings such as to improve the hearing capability of the person, wherein the effect of the hearing device settings on the hearing capability of the user is visualized by means of the picture of the scene;

wherein the picture of the scene is selected to represent the listening situation for which the hearing device settings are to be adjusted; and further wherein step 3 is repeated until a satisfactory improvement of the hearing capability of the person is achieved, or wherein steps 1 to 3 are repeated while the person is wearing the hearing device with the adjusted hearing device settings until a satisfactory improvement of the hearing capability of the person is achieved.

2. Process according to claim 1, wherein the hearing capability includes a hearing ability or a hearing recognition, the process further comprising the step of making at least one hearing dimension visible by means of the picture of the scene at least by varying one of the picture parameters.

3. Process according to claim 2, wherein the at least one hearing dimension is two hearing dimensions, and wherein the picture parameters are at least two parameters.

4. Process according to claim 3, wherein the two hearing dimensions are loudness recognition and understanding.

5. Process according to claim 3, wherein the at least two parameters are brightness and contrast.

6. Process according to one of the claim 2 or 3, wherein the making at least one hearing dimension visible is done in dependency of the frequency range or further properties influencing the hearing ability by means of different picture parameters within one or a plurality of pictures of scenes.

7. Process according to claim 6, wherein the at least one hearing dimension is two or more hearing dimensions.

8. Process according to claim 6, wherein the properties influencing the hearing ability are environmental noise, and/or direction of sound.

9. Process according to claim 6, wherein the different picture parameters are selected from the group consisting of brightness, contrast, image-definition, and different colours.

10. Process according to claim 2, wherein the hearing ability or the hearing recognition is the specific hearing ability or hearing recognition respectively, or the specific reduced hearing ability or hearing recognition respectively, and wherein the varying one of the picture parameters is variation of picture parameters of individual or a plurality of objects within the picture of the scene.

11. Process according to claim 10, wherein the variation of picture parameters is fade-in or fade-out.

12. Process according to claim 2, the making at least one hearing dimension visible is done when the person is using the hearing device by means of at least one picture of the scene.

13. Process according to claim 2, wherein the one hearing dimension is loudness recognition.

14. Process according to claim 2, wherein the picture parameter is brightness.

15. Process according to claim 1, further comprising the step of making at least one hearing dimension visible by means of the picture of the scene at least by varying one of the picture's parameters, wherein the making at least one hearing dimension visible is done at an amplification of an original environmental sound when the person is using the hearing device.

16. Process according to claim 1, further comprising the step of making at least one hearing dimension visible by means of the picture of the scene at least by varying one of the picture's parameters, wherein the making at least one hearing dimension visible is done for at least two frequency ranges when the person is using the hearing device.

17. Process according to claim 16, wherein the making at least one hearing dimension visible is done for at least three frequency ranges, and wherein for each frequency range, the making at least one hearing dimension visible is done in a different colour, and further wherein all the visible hearing dimensions from all the frequency ranges are combined in one single picture of the scene.

18. Process according to claim 17, wherein the at least three frequency ranges are low-sound range, mid-sound range, and high-sound range.

19. Process according to claim 16, wherein the at least two frequency ranges are low-sound range and high-sound range.

20. Process according to one of the claims 12 to 17, wherein by changing the picture parameters, the settings of the hearing device are at least almost being optimised.

21. Process according to claim 20, wherein the picture parameter is selected from the group consisting of brightness, contrast, image-definition, and fade-in or fade-out of different colourings.

22. Process for visualisation of a hearing ability or a hearing recognition respectively of a person with/or without compensation of the person's hearing impairment by means of a hearing device, comprising making at least one hearing dimension visible by means of a picture at least by varying one of the picture parameters, wherein the making at least one hearing dimension visible is done for at least three frequency ranges, and for each frequency range, the making at least one hearing dimension visible is done in a different colour, and wherein all the visible hearing dimensions from all the frequency ranges are combined in one single picture, and further wherein the different colour is blue for the low-sound range, green for the mid-sound range, and red for the high-sound range.

* * * * *